US008699907B2

(12) United States Patent
Zhang et al.

(10) Patent No.: US 8,699,907 B2
(45) Date of Patent: Apr. 15, 2014

(54) SYSTEM AND METHOD TO REMOVE SURFACE CONTAMINANTS FROM IMAGE TRANSFER BLANKET

(75) Inventors: Daihua Zhang, Newark, CA (US); Michael H Lee, San Jose, CA (US); Napoleon J Leoni, San Jose, CA (US); Omer Gila, Cupertino, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 350 days.

(21) Appl. No.: 13/211,680

(22) Filed: Aug. 17, 2011

(65) Prior Publication Data

US 2013/0045022 A1 Feb. 21, 2013

(51) Int. Cl.
*G03G 15/00* (2006.01)
*G03G 15/16* (2006.01)

(52) U.S. Cl.
USPC ..... 399/71; 399/101

(58) Field of Classification Search
USPC ..... 399/71, 101, 297
See application file for complete search history.

(56) References Cited

U.S. PATENT DOCUMENTS 6,201,940 B1 * 3/2001 Lee ..... 399/101
6,263,176 B1 * 7/2001 An et al. ..... 399/101

* cited by examiner

*Primary Examiner* — William J Royer

(57) ABSTRACT

A cleaning system usable with an image forming apparatus, which includes an intermediate transfer member having an image transfer blanket, includes a cleaning unit including a cleaner roller having at least one channel to transport fluid therein and a cleaner receiving surface to receive a cleaner layer, and a control unit including a temperature control module to control transportation of the fluid through the at least one channel to regulate a temperature of the cleaner roller, with the cleaner layer formed on the cleaner receiving surface to remove surface contaminants from the image transfer blanket.

20 Claims, 9 Drawing Sheets

SYSTEM AND METHOD TO REMOVE SURFACE CONTAMINANTS FROM IMAGE TRANSFER BLANKET

BACKGROUND

Image forming apparatuses such as a liquid electrophotography printing apparatus includes an ink applicator unit such as binary ink developers to provide ink such as charged liquid toner to a latent image on a photoconductive member to form ink images. The photoconductive member transfers the ink images onto an image transfer blanket. Subsequently, the image transfer blanket transfers the ink images to media.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

Figure 1:
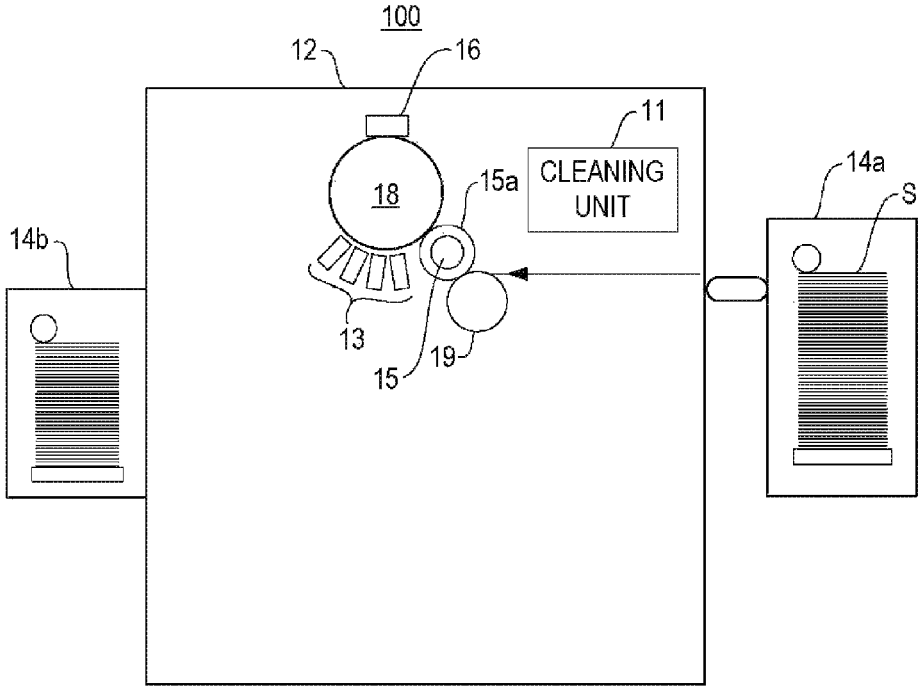
FIG. 1 is a schematic view illustrating an image forming apparatus such as a liquid electrophotography printing apparatus according to an example.

In the following detailed description, reference is made to the accompanying drawings which form a part hereof, and in which is depicted by way of illustration specific examples in which the present disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Image forming apparatuses such as a liquid electrophotography printing apparatus (LEP) includes an ink applicator unit such as binary ink developers (BIDs) to form ink images on a photoconductive member with ink such as liquid toner, for example, Electrolnk, trademarked by Hewlett-Packard Company. The liquid toner is charged and is provided to a latent image on the photoconductive member such as a photo imaging member (PIP) to form the ink images. The photoconductive member, in turn, provides the image to an image transfer blanket of an intermediate transfer member. The image transfer blanket transfers the image onto media. Over time, the image transfer blanket may exhibit memory resulting in portions of the image transfer blanket having variations in texture and gloss with respect to each other. Such memory, for example, may be due to surface contaminants such as residual ink solids accumulating on a surface of the image transfer blanket. The variations may result in undesirable variations in gloss and optical density of the image printed on the media. Accordingly, image quality and/or the lifespan of the image transfer blanket may be decreased.

In examples, a cleaning system usable with an image forming apparatus including an intermediate transfer member having an image transfer blanket includes, among other things, a cleaning unit and a cleaner layer. The cleaning unit includes a cleaner roller having at least one channel to transport fluid therein and a cleaner receiving surface to receive a cleaner layer. The cleaning unit also includes a control unit including a temperature control module to control transportation of the fluid through the at least one channel to regulate a temperature of the cleaner roller. For example, a chilled cleaner roller may facilitate an attraction of surface contaminants to the cleaner layer disposed thereon. The cleaner layer is formed on the cleaner receiving surface to remove surface contaminants from the image transfer blanket. The cleaner layer may include an ink image in a dry state. Accordingly, image transfer blanket memory and undesirable variations in gloss and optical density thereof may be reduced. Thus, a reduction in image quality and/or the lifespan of the image transfer blanket due to surface contaminants may be decreased. Also, alteration of image transfer blanket wetness, ink transfer problems, and a reduction in image forming apparatus throughput is reduced.

FIG. 1 is a schematic view illustrating an image forming apparatus such as a liquid electrophotography system (LEP) according to an example. Referring to FIG. 1, an image forming apparatus 100 includes an image forming unit 12 that receives media S from an input unit 14*a* and outputs the media S to an output unit 14*b*. The image forming unit 12 includes an ink applicator unit 13 and a photoconductive member 18 on which images can be formed. The photoconductive member 18 may be charged with a suitable charger (not illustrated) such as a charge roller. Portions of the outer surface of the photoconductive member 18 that correspond to features of the image can be selectively discharged by a laser writing unit 16 to form an electrostatic and/or latent image thereon.

The ink applicator unit 13 applies the ink such as liquid toner to the electrostatic and/or latent image to form an ink image on the photoconductive member 18 to be transferred to an image transfer blanket 15*a* of an intermediate transfer member (ITM) 15. In some examples, the image transfer blanket 15*a* may include polydimethylsiloxane (PDMS). Subsequently, the image transfer blanket 15*a* transfers the ink image to the media S. During the transfer of the ink image from the image transfer blanket 15*a* to the media S, the media S is pinched between image transfer blanket 15*a* and an impression roller or member 19. The image forming apparatus 100 also includes a cleaning unit 11 to clean the image transfer blanket 15*a*. That is, the cleaning unit 11 may remove surface contaminants such as residual ink solids from the image transfer blanket 15*a*, for example, after the ink image is transferred to the media S. Once the ink image has been transferred to the media S, the media S can be transported to the output unit 14*b*.

Figure 2:
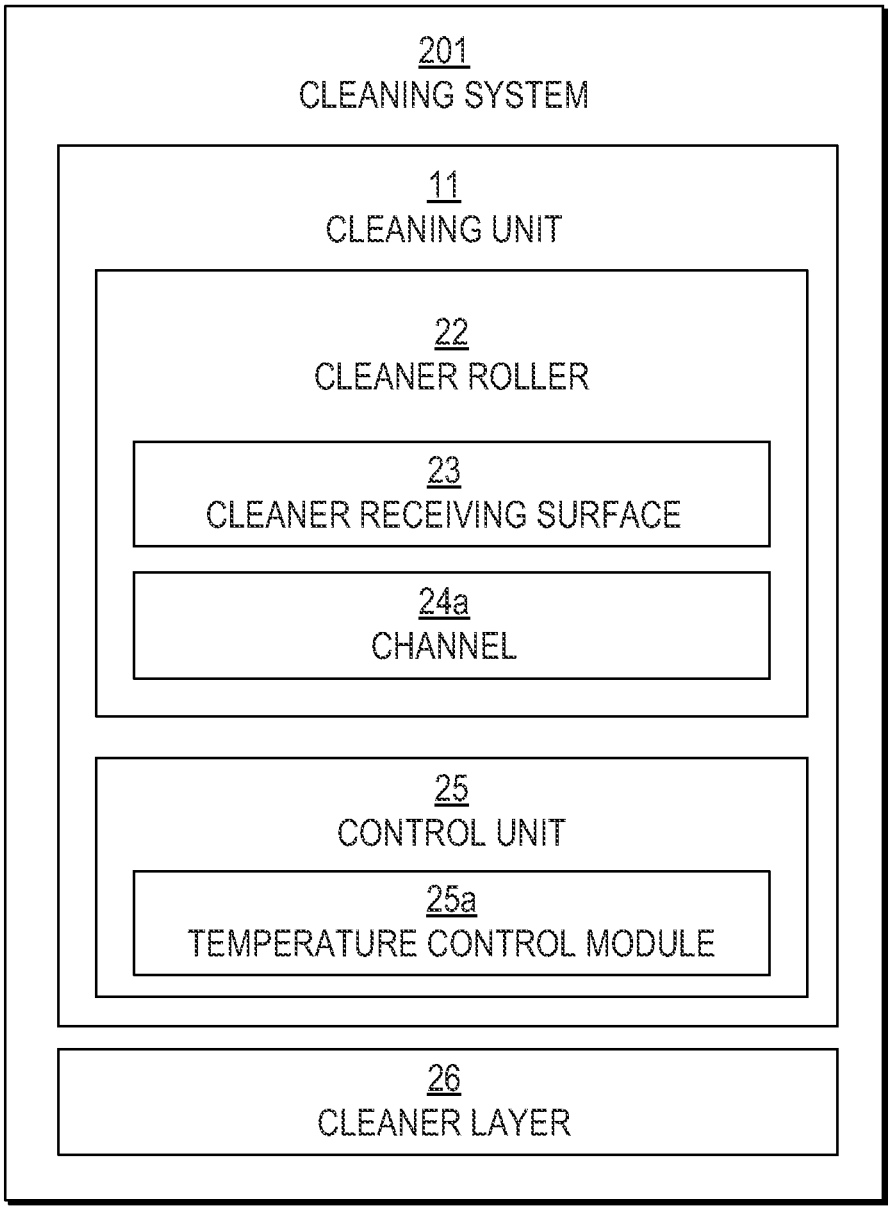
FIG. 2 is a block diagram illustrating a cleaning system usable with an image forming apparatus including an intermediate transfer member having an image transfer blanket according to an example.

FIG. 2 is a block diagram illustrating a cleaning system usable with an image forming apparatus including an intermediate transfer member having an image transfer blanket according to an example. A cleaning system 201 may be usable with an image forming apparatus 100 including an intermediate transfer member 15 having an image transfer blanket 15*a*. Referring to FIG. 2, in some examples, a cleaning system 201 includes a cleaning unit 11 and a cleaner layer 26. The cleaning unit 11 includes a cleaner roller 22 and a control unit 25. The cleaner roller 22 includes a cleaner receiving surface 23 to receive the cleaner layer 26 and at least one channel 24*a* to transport fluid therein. The control unit 25 may include a temperature control module 25*a* to control transportation of the fluid through the channel 24*a* to regulate a temperature of the cleaner roller 22. The cleaner layer 26 may be formed on the cleaner receiving surface 23 to remove surface contaminants from the image transfer blanket 15*a*.

Figure 3:
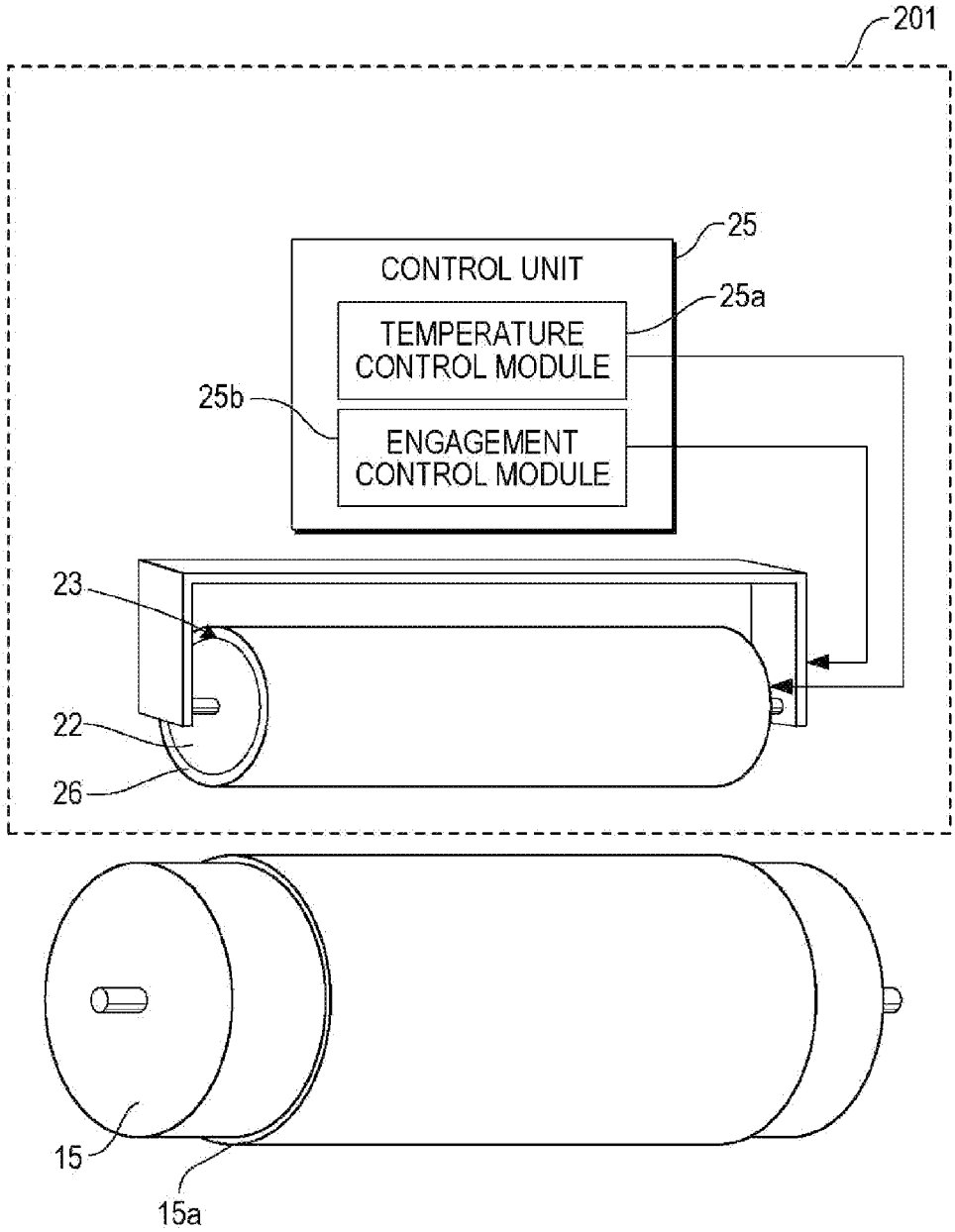
FIG. 3 is a schematic view illustrating the cleaning system of FIG. 2 according to an example.
Figure 4:
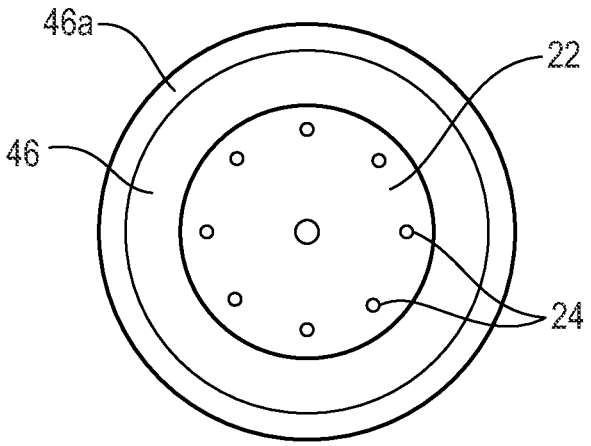
FIG. 4 is a cross-sectional view illustrating a cleaner roller and a cleaner layer of the cleaning system of FIG. 2 according to an example.
Figure 5A:
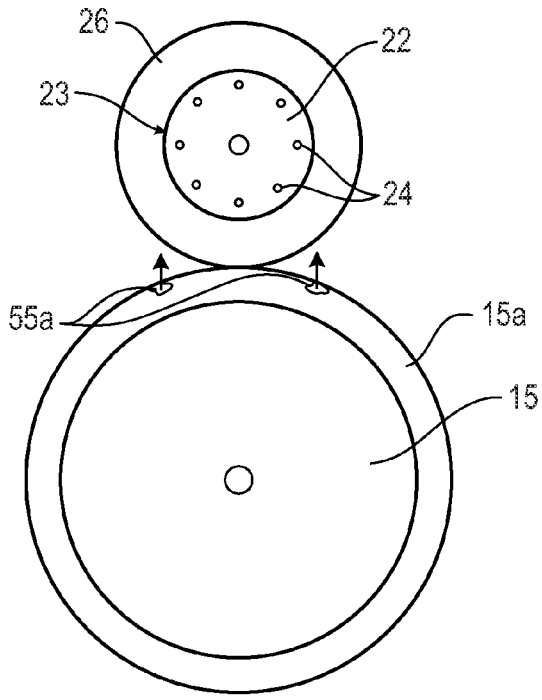
FIGS. 5A and 5B are cross-sectional views illustrating a cleaner roller and a cleaner layer of the cleaning system of FIG. 2 illustrating transfer of surface contaminates between the cleaner layer and an image transfer blanket of an image forming apparatus according to examples.
Figure 5B:
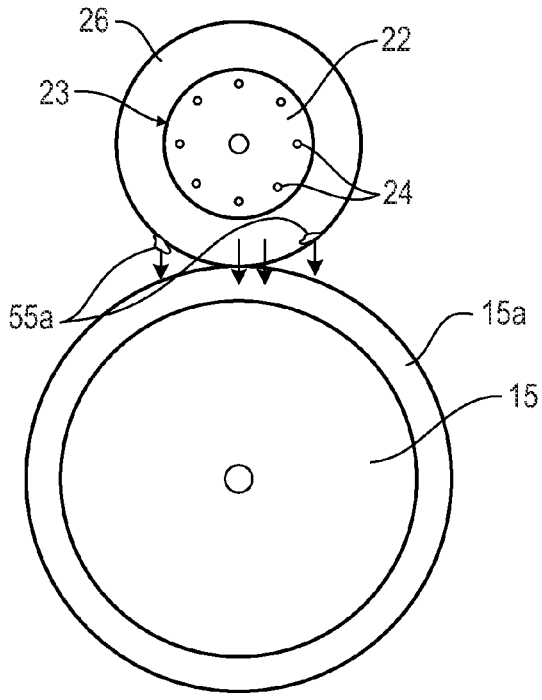

FIG. 3 is a schematic view illustrating a cleaning system of FIG. 2 in a non-engagement state with an image transfer blanket of an image forming apparatus according to an example. FIG. 4 is a cross-sectional view illustrating a cleaner roller and a cleaner layer of the cleaning system of FIG. 2 according to an example. FIGS. 5A and 5B are cross-sectional views illustrating a cleaner roller and a cleaner layer of the cleaning system of FIG. 2 transferring surface contaminates between the cleaner layer and an image transfer blanket of an image forming apparatus according to examples. Referring to FIGS. 3-5B, in some examples, a cleaning system 201 includes a cleaning unit 11 (FIG. 2) and a cleaner layer 26. The cleaning unit 11 includes a cleaner roller 22 and a control unit 25. The cleaner roller 22 includes a cleaner receiving surface 23 to receive the cleaner layer 26 and channels 24 to transport fluid therein.

In some examples, the cleaner layer 26 may be an ink image in a dry state. For example, the ink image may be selectively formed on the cleaner receiving surface 23 during operation of the image forming apparatus 100 and become dry prior to contacting and cleaning the image transfer blanket 15*a*. That is, in some examples, formation of the ink image on the cleaner receiving surface 23 may be performed as an online operation. For example, the ink applicator unit 13 may form an image on the photoconductive member 18. The photoconductive member 18 may transfer the image to the image transfer blanket 15*a*. The image transfer blanket 15*a* may then transfer the image in the form of a cleaner layer 26 to the cleaner receiving surface 23 of the cleaner roller 22. In some examples, the cleaning of the image transfer blanket 15*a* may occur in real-time. Alternatively, the cleaner layer 26 may include a removable cleaner liner 46 having an ink image 46*a* formed thereon in a dry state as illustrated in FIG. 4. For example, the cleaner liner 46 may be a thin plastic membrane such as window-cling that may be removably attached to the cleaner receiving surface 23 of the cleaner roller 22.

Referring to FIGS. 3-5B, in some examples, the control unit 25 may include an engagement control module 25*b* and a temperature control module 25*a*. The engagement control module 25*b* may control placement of the cleaner layer 26 into an engagement state (FIG. 5A) to contact and clean the image transfer blanket 15*a*. For example, the engagement control module 25*b* may control placement of the cleaner layer 26 in the engagement state to clean the image transfer blanket 15*a* after every impression, a predetermined number of impressions, and the like. The engagement control module 25*b* may also control placement of the cleaner layer 26 in a non-engagement state (FIG. 3) to move the cleaner layer 26 out of contact with the image transfer blanket 15*a*. For example, the engagement control module 25*b* may selectively initiate movement of the cleaner roller 22 towards and away from the image transfer blanket 15*a* through movement of a frame connected to the cleaner roller 22 such as through the use of air cylinders, through movement of the cleaner roller 22 with respect to the frame, and the like.

In examples, the control unit 25 including the temperature control module 25*a* and/or the engagement control module 25*b* may be implemented in hardware, software, or in a combination of hardware and software. In examples, the control unit 25 may be implemented in whole or in part as a computer program such as the set of control machine-readable instructions stored in the image forming apparatus 100 locally or remotely. For example, the computer program may be stored in a memory such as a server or a host computing device considered herein, in examples, as part of the image forming apparatus 100.

Referring to FIGS. 3-5B, in some examples, the temperature control module 25*a* may regulate the temperature of the cleaner roller 22 within a first predetermined temperature range in the engagement state to attract surface contaminants 55*a* from the image transfer blanket 15*a* to the cleaner layer 26 (FIG. 5A). For example, the first predetermined temperature range may be from approximately ten degrees to seventy degrees Celsius. In some examples, the temperature control module 25*a* may also regulate the temperature of the cleaner roller 22 within a second predetermined temperature range in the engagement state to transfer the cleaner layer 26 and the surface contaminants 55*a* thereon from the cleaner roller 22 to the image transfer blanket 15*a* (FIG. 5B). The second predetermined temperature range may be from approximately one hundred to one hundred and sixty degrees Celsius.

In some examples, the temperature control module 25*a* of the control unit 25 may control transportation of the fluid through the channels 24 to regulate the temperature of the cleaner roller 22. For example, the temperature control module 25*a* may allow the fluid to pass through the channels 24 to maintain the temperature of the cleaner roller 22 in the first predetermined temperature range and stop transportation of the flow of fluid through the channels 24 to maintain the temperature of the cleaner roller 22 in the second predetermined temperature. The temperature control module 25*a* may also regulate the temperature of the cleaner roller 22 by changing the temperature of the fluid to flow through the channels 24 of the cleaner roller 22 to maintain the temperature of the cleaner roller 22 within the first and second predetermined temperature range, respectively, using, for example, a combination of a radiator and a cartridge heater. In some examples, heat from the image transfer blanket 15*a* may heat the cleaner roller 22, for example, within the predetermined second temperature range, in response to stopping the fluid from flowing through the channels 24. The channels 24 may be approximately equally spaced apart from each other to uniformly cool and/or heat the cleaner receiving surface 23 of the cleaner roller 22 and/or the cleaner layer 26 disposed thereon.

Figure 6:
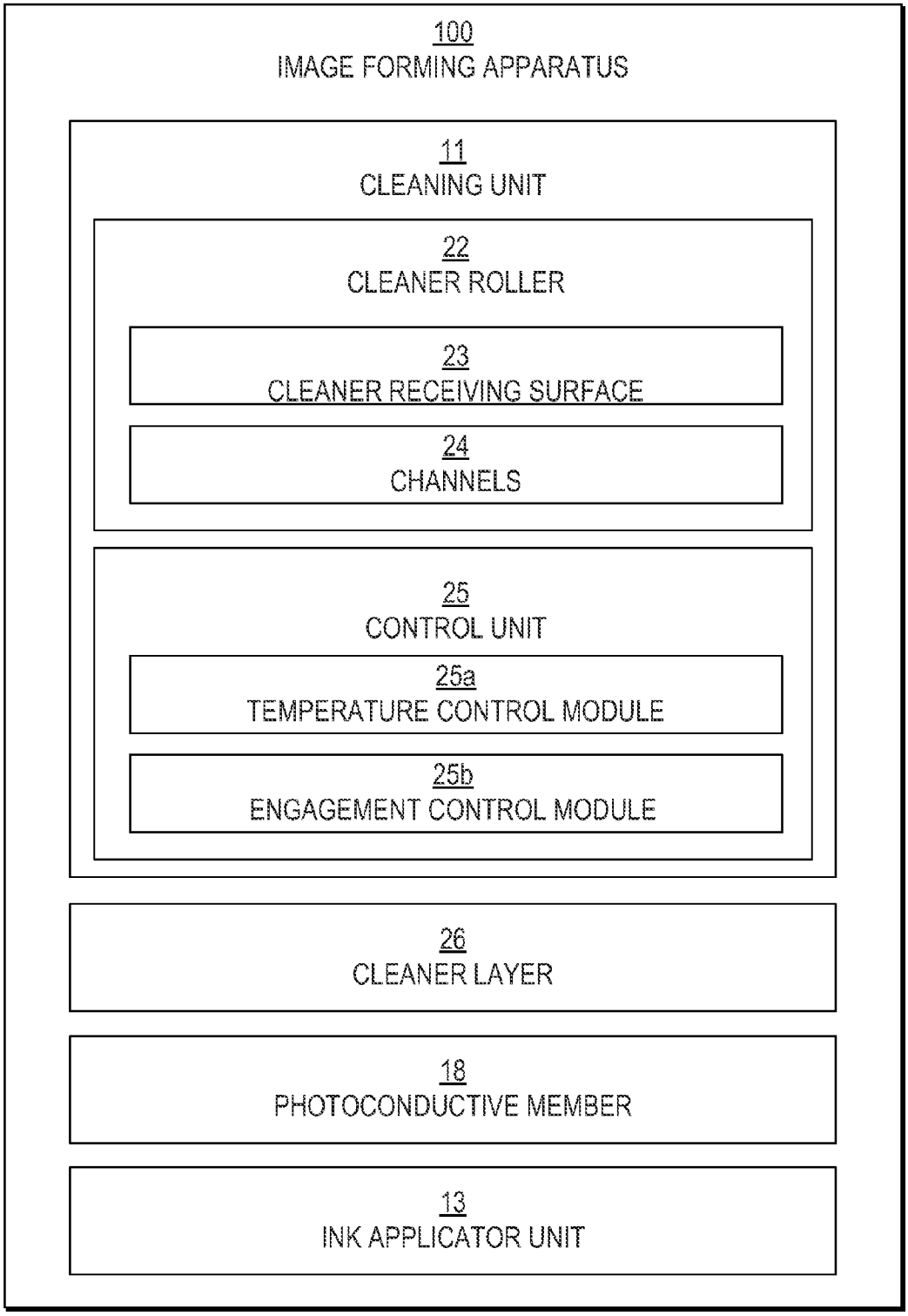
FIG. 6 is a block diagram illustrating an image forming apparatus according to an example.

FIG. 6 is a block diagram illustrating an image forming apparatus according to an example. Referring to FIG. 6, in some examples, an image forming apparatus 100 includes a cleaning unit 11, a cleaner layer 26, a photoconductive member 18, and an ink applicator unit 13. The cleaning unit 11 includes a cleaner roller 22 and a control unit 25. The cleaner roller 22 includes a cleaner receiving surface 23 to receive a cleaner layer 26 and channels 24 to transport fluid therein.

The control unit 25 includes a temperature control module 25*a* to control transportation of the fluid through the channels 24 to regulate a temperature of the cleaner roller 22 between a first predetermined temperature range and a second predetermined temperature range as previously disclosed with respect to FIGS. 2-5B. In some examples, the fluid may be a mixture of water and ethylene glycol, and the like, with the respective fractions chosen to be compatible with the second predetermined temperature range.

Referring to FIG. 6, in some examples, the control unit 25 may also include an engagement control module 25*b* to control placement of the cleaner layer 26 into an engagement state (FIG. 5A) to contact and clean the image transfer blanket 15*a* and a non-engagement state (FIG. 3) to move the cleaner layer 26 out of contact with the image transfer blanket 15*a*. The cleaner layer 26 may be formed on the cleaner receiving surface 23 to remove surface contaminants 55*a* from the image transfer blanket 15*a*. The photoconductive member 18 may form a latent image thereon. For example, the latent image may correspond to image data received by the image forming apparatus 100. The ink applicator unit 13 may provide ink to the latent image on the photoconductive member 18 to form an ink image thereon in a print mode and to form the cleaner layer 26 on the cleaner receiving surface 23 in a cleaner layer formation mode. That is, in the cleaner layer formation mode, for example, the ink applicator unit 13 may form an image on the photoconductive member 18. The photoconductive member 18 may transfer the image to the image transfer blanket 15*a*. The image transfer blanket 15*a* may then transfer the image in the form of the cleaner layer 26 to the cleaner receiving surface 23 of the cleaner roller 22.

Figure 7:
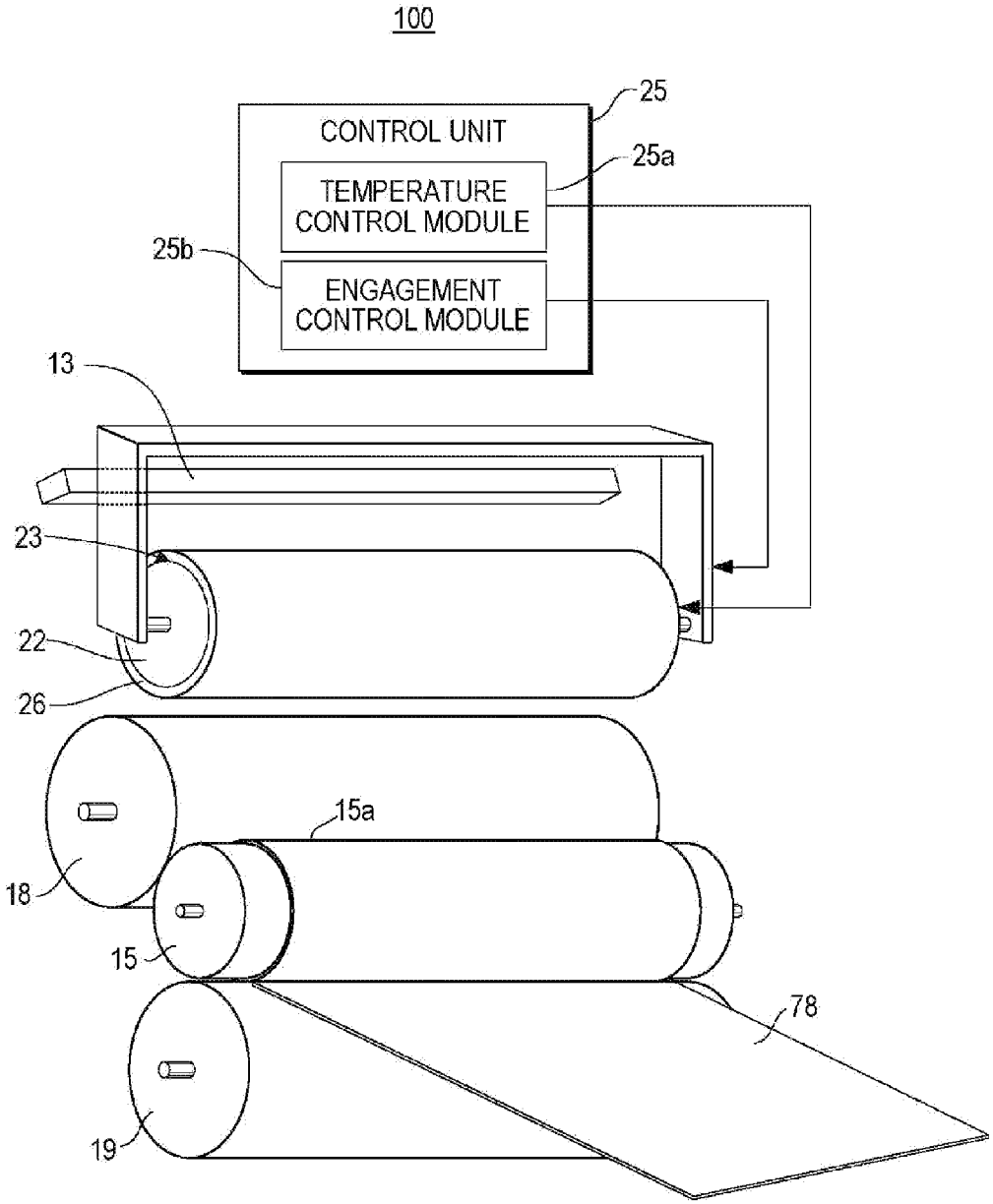
FIG. 7 is a schematic view illustrating the image forming apparatus of FIG. 6 according to an example.
Figure 8:
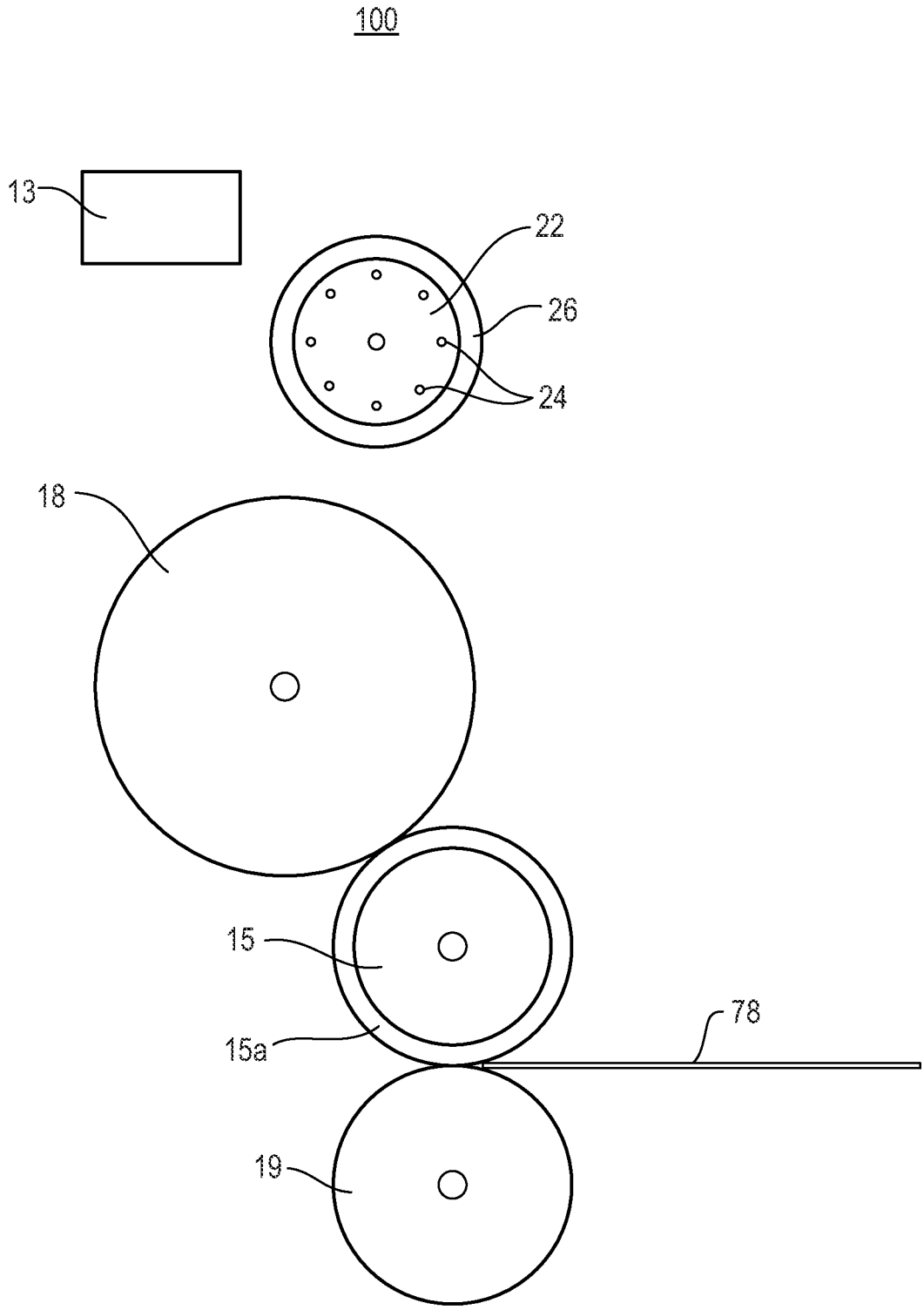
FIG. 8 is a cross-sectional view illustrating the image transfer blanket of FIG. 7 according to an example.

FIG. 7 is a schematic view illustrating the image forming apparatus of FIG. 6 according to an example. FIG. 8 is a cross-sectional view illustrating the image forming apparatus of FIG. 7 according to an example. Referring to FIGS. 7 and 8, in some examples, an image forming apparatus 100 includes a cleaning unit 11 (FIG. 6), a cleaner layer 26, a photoconductive member 18, an impression roller or member 19, and an ink applicator unit 13. The cleaning unit 11 includes a cleaner roller 22, a control unit 25, and a cleaner member 78. The cleaner roller 22 includes a cleaner receiving surface 23 to receive a cleaner layer 26 and channels 24 to transport fluid therein. For example, the fluid may be cooled and/or heated mixture of water and ethylene glycol, and the like.

In some examples, the cleaner layer 26 may be an ink image in a dry state. The ink image may be selectively formed on the cleaner receiving surface 23 during operation of the image forming apparatus 100 and become dry prior to contacting and cleaning the image transfer blanket 15*a*. That is, in some examples, formation of the ink image on the cleaner receiving surface 23 may be performed as an online operation. Alternatively, the cleaner layer 26 may include a removable cleaner liner 46 having an ink image 46*a* formed thereon in a dry state as illustrated in FIG. 4. For example, the cleaner liner 46 may be a thin plastic membrane such as window-cling that may be removably attached to the cleaner receiving surface 23 of the cleaner roller 22.

Referring to FIGS. 7 and 8, in some examples, the control unit 25 includes a temperature control module 25*a* and an engagement control module 25*b* to control placement of the cleaner layer 26 into an engagement state (FIG. 5A) to contact and clean the image transfer blanket 15*a* and a non-engagement state (FIG. 3) to move the cleaner layer 26 out of contact with the image transfer blanket 15*a*. The temperature control module 25*a* may regulate the temperature of the cleaner roller 22 by allowing the fluid to pass through the channels 24 to regulate the temperature of the cleaner roller 22. For example, the temperature control module 25*a* may selectively allow transportation of the fluid through the channels 24 to maintain the temperature of the cleaner roller 22 in the first predetermined temperature range and stop the flow of fluid through the channels 24 to maintain the temperature of the cleaner roller 22 in the second predetermined temperature. The temperature control module 25*a* may also regulate the temperature of the cleaner roller 22 by changing the temperature of the fluid to flow through the channels 24 of the cleaner roller 22 to selectively maintain the temperature of the cleaner roller 22 within the first and second predetermined temperature range, respectively.

The temperature control module 25*a* may regulate the temperature of the cleaner roller 22 in a first predetermined temperature range in the engagement state (FIG. 5A) to attract the surface contaminants 55*a* from the image transfer blanket 15*a* to the cleaner layer 26. The temperature control module 25*a* may also regulate the temperature of the cleaner roller 22 in a second predetermined temperature range in the engagement state (FIG. 5B) to transfer the cleaner layer 26 and the surface contaminants 55*a* from the cleaner roller 22 to the image transfer blanket 15*a*. In some examples, the first predetermined temperature range is less than the second predetermined temperature range. For example, the first predetermined temperature range may be approximately ten degrees to seventy degrees Celsius and the second predetermined temperature range may be approximately one hundred to one hundred and sixty degrees Celsius.

Referring to FIGS. 7 and 8, in some examples, the impression roller or member 19 may press media against the image transfer blanket 15*a* to receive the ink image therefrom. The cleaner member 78 may clean the cleaner layer 26 and the surface contaminants 55*a* from the image transfer blanket 15*a* placed thereon by the cleaner roller 22 in response to the cleaner layer 26 placed in the engagement state (FIG. 5B) and having the temperature in the second predetermined temperature range. For example, a heated cleaner roller 22 may facilitate the transfer of the cleaner layer 26 and surface contaminants 55*a* from the cleaner roller 22 to the image transfer blanket 15*a*. In some examples, the cleaner member 78 may be a cleaner page. The cleaner page, for example, may include a solid yellow image.

Figure 9:
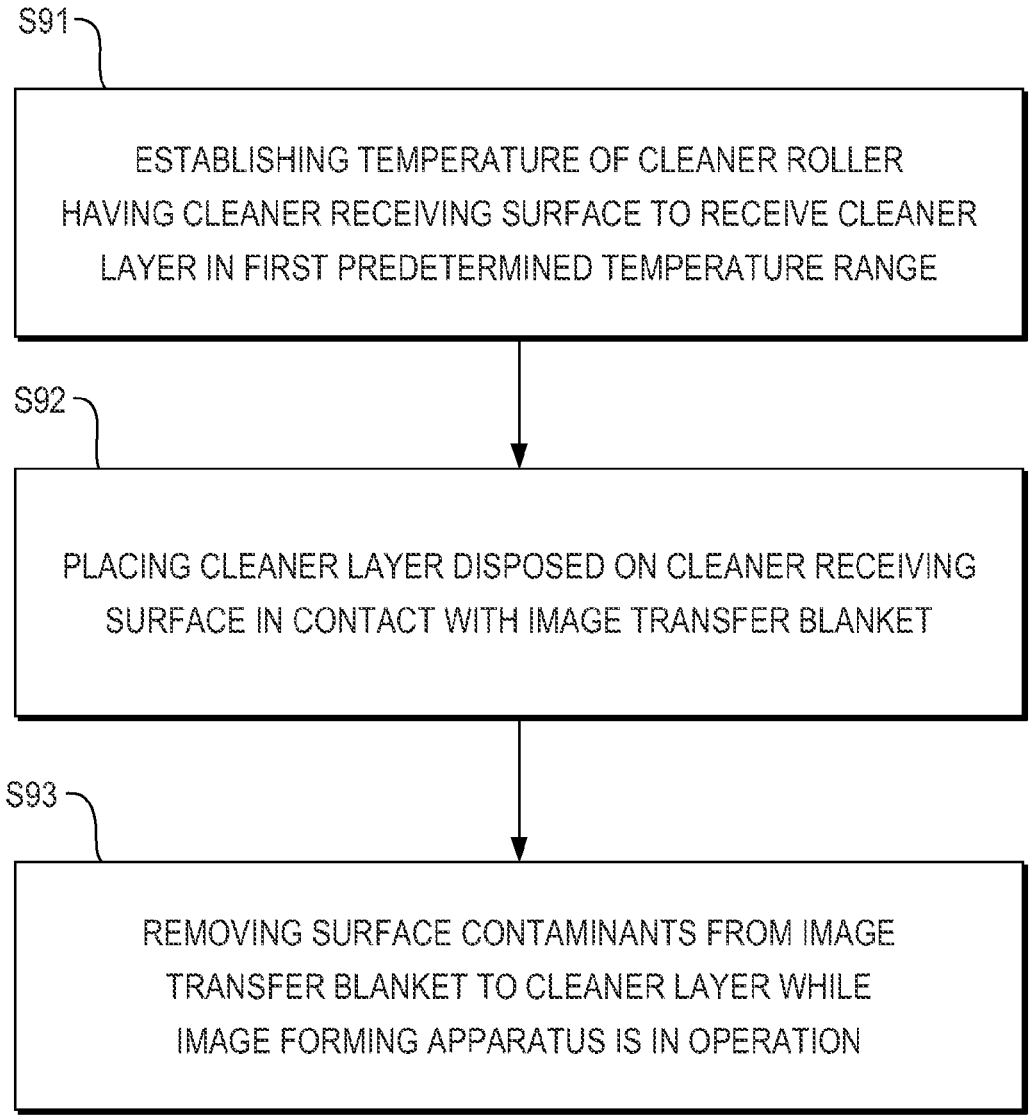
FIG. 9 is a flowchart illustrating a method of cleaning an image transfer blanket of an image forming apparatus according to an example.

FIG. 9 is a flowchart illustrating a method of cleaning an image transfer blanket of an image forming apparatus according to an example. In block S91, a temperature of a cleaner roller having a cleaner receiving surface to receive a cleaner layer is established in a first predetermined temperature range. For example, the first predetermined temperature range of a cleaner roller may be established by changing a temperature of fluid and directing the fluid through channels in the cleaner roller. In block S92, the cleaner layer disposed on the cleaner receiving surface is placed in contact with the image transfer blanket. In some examples, the cleaner layer may include a removable cleaner liner, for example, having an ink image in a dry state thereon. In some examples, the cleaner layer may be in a form of an ink image in a dry state, for example, disposed directly on the cleaner receiving surface of the cleaner roller. In block S93, surface contaminants are removed from the image transfer blanket to the cleaner layer while the image forming apparatus is in operation.

In some examples, the method may also include formation of the cleaner layer on the cleaner receiving surface in a form of an ink image in a dry state while the image forming apparatus is in operation. The method may also include establishment of a second predetermined temperature range of the cleaner roller greater than the first predetermined temperature range, placement of the cleaner layer disposed on the cleaner receiving surface in contact with the image transfer blanket to transfer the cleaner layer and the surface contaminants thereon to the image transfer blanket, and removal of the cleaner layer and the surface contaminants from the image transfer blanket.

It is to be understood that the flowchart of FIG. 9 illustrates an architecture, functionality, and operation of an example of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 9 illustrates a specific order of execution, the order of execution may differ from that which is depicted. For example, the order of execution of two or more blocks may be scrambled relative to the order illustrated. Also, two or more blocks illustrated in succession in FIG. 9 may be executed concurrently or with partial concurrence. All such variations are within the scope of the present disclosure.

The present disclosure has been described using non-limiting detailed descriptions of examples thereof and is not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the present disclosure and/or claims, "including but not necessarily limited to."

It is noted that some of the above described examples may include structure, acts or details of structures and acts that may not be essential to the present disclosure and are intended to be exemplary. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. A cleaning system usable with an image forming apparatus including an intermediate transfer member having an image transfer blanket, the cleaning system comprising:

a cleaning unit including a cleaner roller having at least one channel to transport fluid therein and a cleaner receiving surface to receive a cleaner layer, and a control unit including a temperature control module to control transportation of the fluid through the at least one channel to regulate a temperature of the cleaner roller; and the cleaner layer formed on the cleaner receiving surface to remove surface contaminants from the image transfer blanket.

2. The cleaning system according to claim 1, wherein the control unit further comprises:

an engagement control module to control placement of the cleaner layer into an engagement state to contact and clean the image transfer blanket and a non-engagement state to move the cleaner layer out of contact with the image transfer blanket.

3. The cleaning system according to claim 2, wherein the temperature control module regulates the temperature of the cleaner roller within a first predetermined temperature range in the engagement state to attract the surface contaminants from the image transfer blanket to the cleaner layer.

4. The cleaning system according to claim 3, wherein the first predetermined temperature range is from ten to seventy degrees Celsius.

5. The cleaning system according to claim 3, wherein the temperature control module regulates the temperature of the cleaner roller within a second predetermined temperature range in the engagement state to transfer the cleaner layer and the surface contaminants thereon from the cleaner roller to the image transfer blanket such that the second predetermined temperature range is from one hundred to one hundred and sixty degrees Celsius.

6. The cleaning system according to claim 5, wherein the temperature control module regulates the temperature of the cleaner roller within the first predetermined range by changing a temperature of the fluid to flow through the at least one channel of the cleaner roller and the temperature control module regulates the temperature of the cleaner roller within the second predetermined range by stopping the flow of the fluid through the at least one channel of the cleaner roller.

7. The cleaning system according to claim 1, wherein the cleaner layer comprises an ink image in a dry state.

8. The cleaning system according to claim 7, wherein the ink image is selectively formed on the cleaner receiving surface during operation of the image forming apparatus.

9. The cleaning system according to claim 1, wherein the cleaner layer comprises a removable cleaner liner having an ink image formed thereon in a dry state.

10. An image forming apparatus, comprising:

a cleaning unit including a cleaner roller and a control unit;

the cleaner roller having a cleaner receiving surface to receive a cleaner layer and a plurality of channels to transport fluid therein; and the control unit including a temperature control module to control transportation of the fluid through the channels to regulate a temperature of the cleaner roller between a first predetermined temperature range and a second predetermined temperature range and an engagement control module to control placement of the cleaner layer into an engagement state to contact and clean an image transfer blanket and a non-engagement state to move the cleaner layer out of contact with the image transfer blanket;

the cleaner layer formed on the cleaner receiving surface of the cleaner roller to remove surface contaminants from the image transfer blanket;

a photoconductive member to form a latent image thereon; and an ink applicator unit to provide ink to the latent image on the photoconductive member to form an ink image thereon in a print mode and to form the cleaner layer on the cleaner receiving surface in a cleaner layer formation mode.

11. The image forming apparatus according to claim 10, further comprising:

an impression roller to press media against the image transfer blanket to receive the ink image therefrom.

12. The image forming apparatus according to claim 10, wherein the cleaner layer comprises an ink image in a dry state.

13. The image forming apparatus according to claim 10, wherein the temperature control module regulates the temperature of the cleaner roller within the first predetermined temperature range by changing a temperature of the fluid to flow through the channels of the cleaner roller and the temperature control module regulates the temperature of the cleaner roller within the second predetermined temperature range by at least one of changing the temperature of the fluid to flow through the channels of the cleaner roller and stopping the flow of the fluid through the channels of the cleaner roller.

14. The image forming apparatus according to claim 10, wherein the temperature control module regulates the temperature of the cleaner roller in the first predetermined temperature range in the engagement state to attract the surface contaminants from the image transfer blanket to the cleaner layer and in the second predetermined temperature range in the engagement state to transfer the cleaner layer and the surface contaminants from the cleaner roller to the image transfer blanket such that the first predetermined temperature range is less than the second predetermined temperature range.

15. The image forming apparatus according to claim 14, wherein the cleaning unit further comprises:

a cleaner member to remove the cleaner layer and the surface contaminants from the image transfer blanket placed thereon by the cleaner roller in response to the cleaner layer placed in the engagement state and having the temperature in the second predetermined temperature range.

16. A method of cleaning an image transfer blanket of an image forming apparatus, the method comprising:

establishing a temperature of a cleaner roller having a cleaner receiving surface to receive a cleaner layer in a first predetermined temperature range;

placing the cleaner layer disposed on the cleaner receiving surface in contact with the image transfer blanket; and removing surface contaminants from the image transfer blanket to the cleaner layer while the image forming apparatus is in operation.

17. The method according to claim 16, wherein the establishing a first predetermined temperature range of the cleaner roller further comprises:

changing a temperature of a fluid; and directing the fluid through channels in the cleaner roller.

18. The method according to claim 16, further comprising:

forming the cleaner layer on the cleaner receiving surface in a form of an ink image in a dry state while the image forming apparatus is in operation.

19. The method according to claim 18, further comprising:

establishing a second predetermined temperature range of the cleaner roller greater than the first predetermined temperature range;

placing the cleaner layer disposed on the cleaner receiving surface in contact with the image transfer blanket to transfer the cleaner layer and the surface contaminants thereon to the image transfer blanket; and removing the cleaner layer and the surface contaminants from the image transfer blanket.

20. The method according to claim 16, wherein the cleaner layer comprises a removable cleaner liner.

* * * * *